US009127472B2

(12) United States Patent
Borg et al.

(10) Patent No.: US 9,127,472 B2
(45) Date of Patent: Sep. 8, 2015

(54) FLOW CONTROL AND INDICATOR ASSEMBLIES

(71) Applicant: ZODIAC POOL SYSTEMS, INC., Vista, CA (US)

(72) Inventors: Dustin Borg, Poway, CA (US); Mark Bauckman, San Marcos, CA (US); Mary Ma, San Diego, CA (US); Kevin Braidic, Carlsbad, CA (US)

(73) Assignee: ZODIAC POOL SYSTEMS, INC., Vista, CA (US)

( * ) Notice: Subject to any disclaimer, the term of this patent is extended or adjusted under 35 U.S.C. 154(b) by 46 days.

(21) Appl. No.: 13/975,438

(22) Filed: Aug. 26, 2013

(65) Prior Publication Data

US 2014/0060671 A1 Mar. 6, 2014

Related U.S. Application Data

(60) Provisional application No. 61/695,456, filed on Aug. 31, 2012.

(51) Int. Cl.
*G05D 11/00* (2006.01)
*E04H 4/16* (2006.01)

(52) U.S. Cl.
CPC ..... *E04H 4/16* (2013.01); *Y10T 137/2572* (2015.04); *Y10T 137/7759* (2015.04)

(58) Field of Classification Search
USPC ..... 137/114, 494, 512.5, 515, 540, 553, 137/602, 614, 895, 907, 100, 101.11, 137/565.23, 505.13, 505.26; 116/277; 15/1.7; 285/283
See application file for complete search history.

(56) References Cited

U.S. PATENT DOCUMENTS

| | | | | | |
|---|---|---|---|---|---|
| 933,786 | A | * | 9/1909 | Richmond | 116/277 |
| 1,853,863 | A | * | 4/1932 | Hornbruch | 431/90 |
| 4,450,861 | A | * | 5/1984 | Bouteille | 137/553 |
| 4,791,950 | A | * | 12/1988 | Pedersen | 137/115.26 |
| D325,621 | S | | 4/1992 | Hengesbach | |
| 5,105,848 | A | * | 4/1992 | Kallenbach | 137/493.1 |
| 5,351,709 | A | * | 10/1994 | Vos | 137/114 |
| 5,363,877 | A | * | 11/1994 | Frentzel et al. | 137/526 |
| 5,720,068 | A | | 2/1998 | Clark et al. | |
| 5,758,691 | A | * | 6/1998 | Nedderman, Jr. | 137/895 |
| D404,118 | S | | 1/1999 | Hwang | |
| D409,287 | S | | 5/1999 | Hansen | |
| 5,904,171 | A | * | 5/1999 | Stahle et al. | 137/114 |
| 6,112,354 | A | * | 9/2000 | Stoltz et al. | 15/1.7 |
| 6,314,983 | B1 | * | 11/2001 | Hatch | 137/114 |
| 6,484,743 | B2 | | 11/2002 | Bauckman | |
| 7,284,565 | B2 | * | 10/2007 | Sebor | 137/114 |
| D633,179 | S | | 2/2011 | Geideman et al. | |
| 8,826,659 | B2 | * | 9/2014 | Shieh | 60/605.1 |
| 2009/0007349 | A1 | * | 1/2009 | Bauckman et al. | 15/1.7 |
| 2011/0226361 | A1 | | 9/2011 | Van der Meijden et al. | |

OTHER PUBLICATIONS

International Search Report and Written Opinion dated Nov. 18, 2013 in Application No. PCT/US2013/056566.

* cited by examiner

*Primary Examiner* — Craig Schneider
*Assistant Examiner* — R. K. Arundale
(74) *Attorney, Agent, or Firm* — Kilpatrick Townsend & Stockton LLP

(57) ABSTRACT

Flow control and indicator assemblies are detailed. The assemblies are especially (although not necessarily exclusively) useful in allowing fluid to bypass automatic pool cleaners (APCs) and may serve as adaptors between APCs and adjacent hoses. The assemblies additionally may provide information about flow rates relative to a desired threshold, for example.

19 Claims, 7 Drawing Sheets

FLOW CONTROL AND INDICATOR ASSEMBLIES

CROSS-REFERENCE TO RELATED APPLICATION

This application claims the benefit of U.S. Provisional Patent Application Ser. No. 61/695,456, filed Aug. 31, 2012, and having the same title as appears above, the entire contents of which application is incorporated herein by this reference.

FIELD OF THE INVENTION

The present invention relates to assemblies through which fluid may flow and more particularly to valving mechanisms both regulating and indicating fluid flow in connection with water-cleaning systems for pools and spas (or otherwise as appropriate).

BACKGROUND OF THE INVENTION

Commonly-owned U.S. Pat. No. 6,484,743 to Bauckman, whose contents are incorporated herein in their entirety by this reference, discloses exemplary flow control assemblies for use especially with automatic swimming pool cleaners (APCs). As disclosed in the Bauckman patent, versions of the assemblies may be "place[d] between lengths of hose or fittings used in swimming pools," for example. See Bauckman, col. 3, 11. 26-27. Such an assembly may include a body having an inlet and an outlet together with a pivoting cover. When the cover pivots to an open position because of reduced pressure inside the body, a bypass inlet to the body is formed. See id., 11. 48-53.

Commonly-owned U.S. Patent Application Publication No. 2011/0226361 of van der Meijden, et al., whose contents likewise are incorporated herein in their entirety by this reference, describes other bypass devices for use principally with pool and spa water-cleaning systems. Referenced in the van der Meijden application as "idler mechanism[s]," at least one version of the devices may be "configured as an interface unit for positioning between a hose and a body of an APC." See van der Meijden, p. 1, ¶0012. This version may include both an inlet and an outlet as well as an additional opening intended, when open, to allow fluid to bypass the APC.

SUMMARY OF THE INVENTION

Protecting APCs from unsuitably high water flow rates may reduce risk of damage to internal components of the APCs and thus prolong their useful lives. The present invention hence provides alternatives to, among others, the bypass devices of the Bauckman patent and the van der Meijden application. In particular, devices of the present invention may function both to allow fluid to bypass APCs and to indicate (at least generally) the rate of fluid flow through their bodies. The devices further may serve as adaptors or interfaces between APCs and hoses, for example, thus requiring their presence as part of water recirculation circuits before the APCs will operate. Placement of the devices adjacent APCs causes them to experience substantially the same flow conditions as do the APCs. Alternatively, as with at least idler mechanisms of the van der Meijden application, devices of the present invention may be incorporated into either or both of an APC or a hose (or elsewhere in a circuit).

Continuously indicating fluid flow rate may assist in diagnosing certain issues sometimes existing in pool and spa water-cleaning systems. Indication of low flow through a device of the present invention may diagnose clogged filters or water lines, undesirably low pump speed, or diversion of fluid from the circuit containing the APC, for example. By contrast, indication of high flow might suggest undesirably high pump speed—thus wasting electricity and potentially diminishing pump life—or other issues.

At least some embodiments of the innovative devices of the present invention may employ spring-loaded pistons as valves. The pistons normally close the bypass openings. However, should sufficient pressure differential exist between the fluid external to a device (e.g. ambient pool or spa water) and the interior of the device, the spring force may be overcome resulting in movement of a piston. As the piston moves relative to its normal position, it opens a bypass port allowing pool water to enter or exit the device (depending on whether the interior pressure is lower or higher than ambient). Presently-preferred versions of the devices intended for use with suction-type APCs allow water to enter the device via the bypass port. By allowing water to enter via the bypass port, water flow entering through a main inlet (connected to an APC) may be maintained at or below a maximum flow rate.

Positioning of the piston at a particular time also provides useful information about fluid flow through a device of the present invention. The piston thus may itself be marked for flow-indicating purposes or connected to or in communication with an indicator of fluid flow. In at least one presently-preferred embodiment of the invention, the piston may have sections of different colors providing visual indications of flow status.

Versions of the devices additionally may incorporate bypass ports of irregular shapes to compensate for non-linear relationships between flow rates and pressure differentials. Additionally, devices may design pistons as dashpots so as to dampen the rate of piston movement in response to changing pressures. Such dampening may be beneficial when, for example, an APC ingests large debris (e.g. a large leaf) that puts temporary additional load on a recirculation system. Rather than have the piston respond immediately to open the bypass port (which thus reduces the suction available to move the debris through the system to a filter), the dashpot design would limit immediate piston movement and retain most of the suction to continue moving the debris. Yet additionally, various travel stops or locking mechanisms may be added to limit piston travel or to latch a piston in a particular position (as can occur in assemblies of the Bauckman patent, for example).

It thus is an optional, non-exclusive object of the present invention to provide flow control assemblies.

It is another optional, non-exclusive object of the present invention to provide assemblies that both control and indicate flow.

It is also an optional, non-exclusive object of the present invention to provide flow control and indicator assemblies configured to function as adaptors or interfaces between APCs and hoses of pool- or spa-water recirculation systems.

It is a further optional, non-exclusive object of the present invention to provide flow control assemblies having spring-loaded pistons normally closing bypass openings.

It is, moreover, an optional, non-exclusive object of the present invention to provide flow control assemblies in which sections of pistons may be colored differently for purposes of providing visible flow indication information.

It is an additional optional, non-exclusive object of the present invention to provide flow control assemblies having irregularly-shaped bypass openings.

It is yet another optional, non-exclusive object of the present invention to provide flow control assemblies with pistons acting as dashpots or with travel stops or latching mechanisms for pistons.

Other objects, features, and advantages of the present invention will be apparent to those skilled in relevant fields with reference to the remaining text and the drawings of this application.

DETAILED DESCRIPTION

Figure 4C:
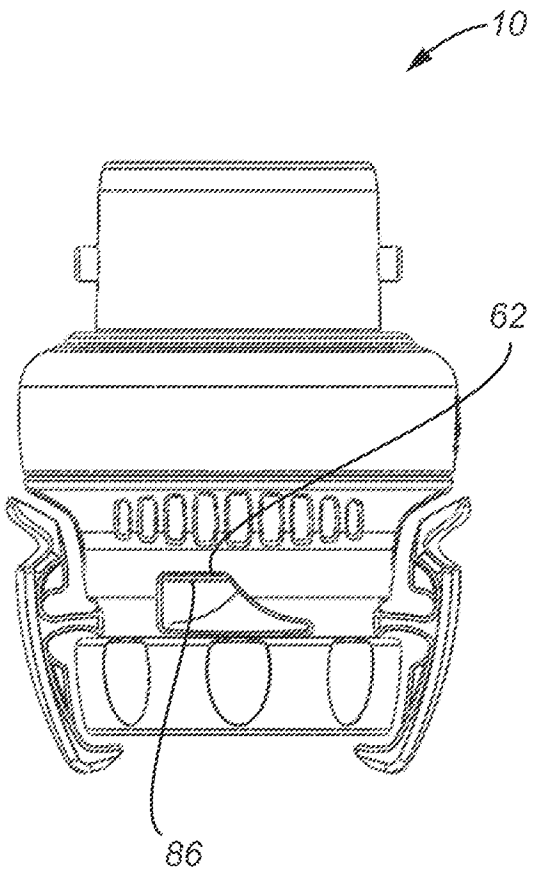
FIGS. 4A-C are elevational views of the assembly of FIG. 1 illustrating different positions of a piston of the assembly.
Figure 4B:
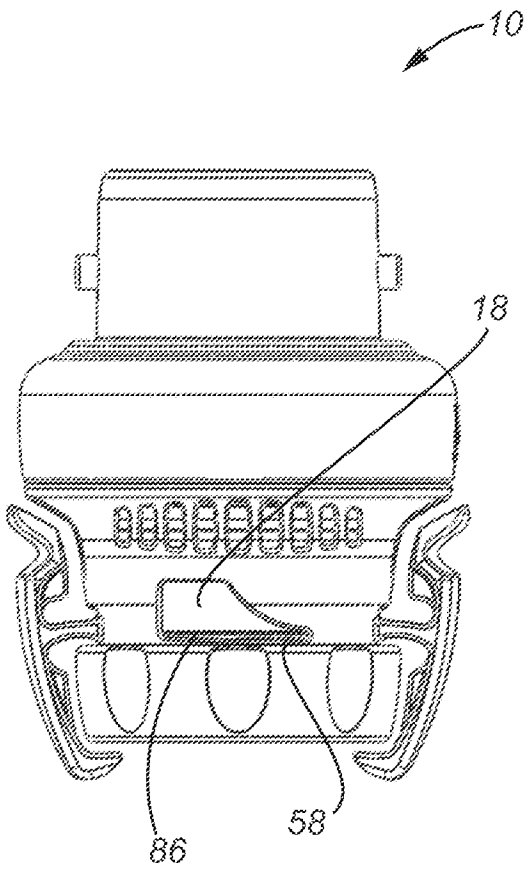
Figure 4A:
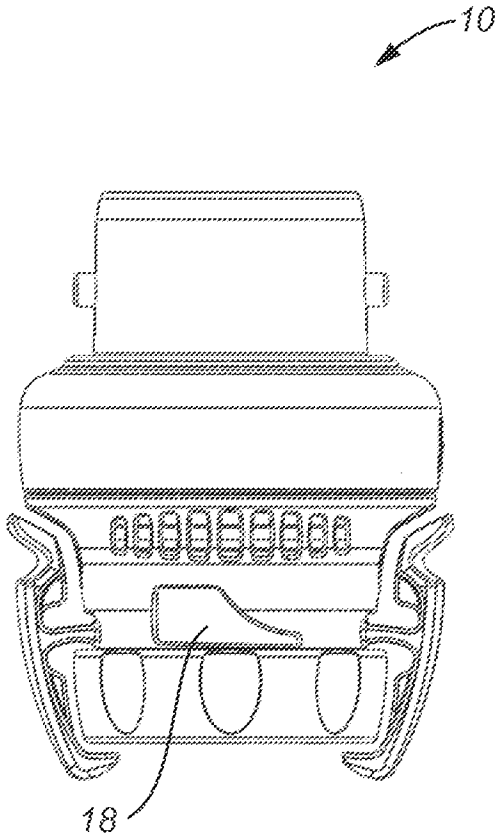
Figure 5:
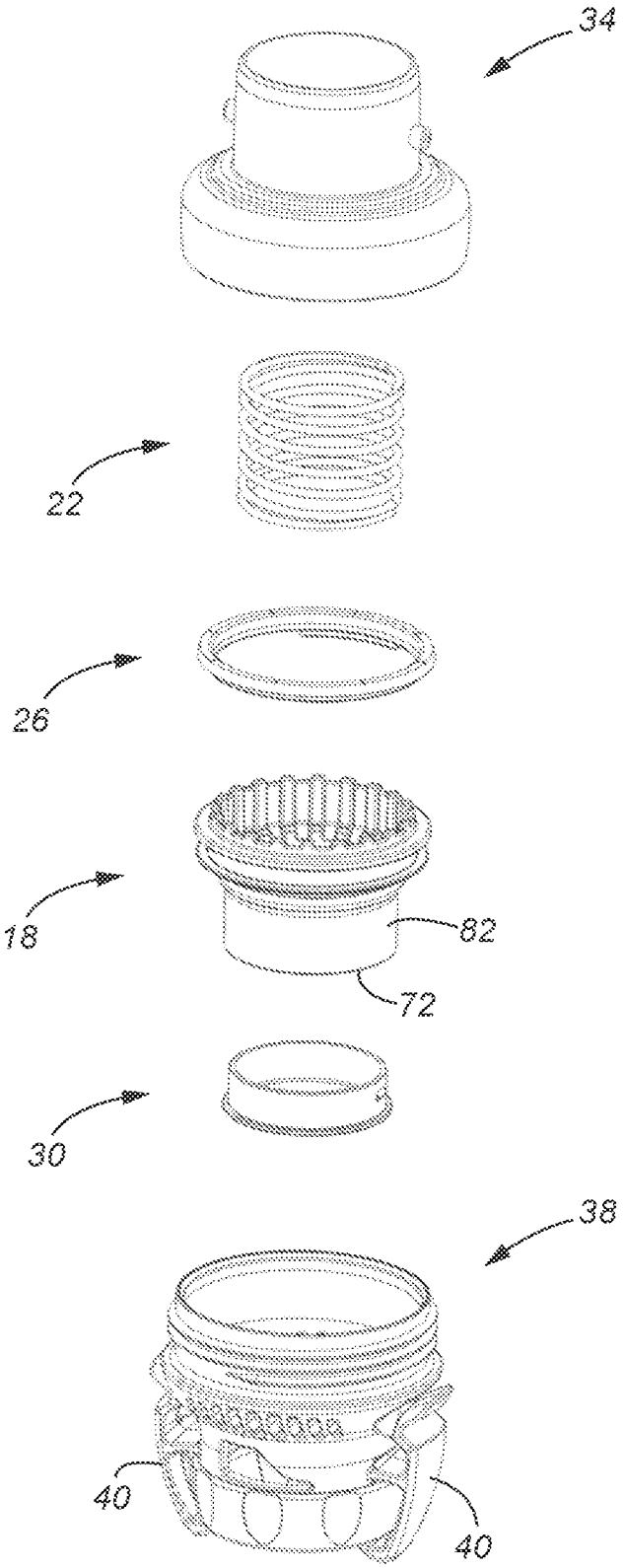
FIG. 5 is an exploded view of the assembly of FIG. 1.

Depicted in FIGS. 1-5 is exemplary flow control assembly 10 consistent with the present invention. Assembly 10 preferably comprises body 14, piston 18, and a biasing mechanism such as spring 22. Also illustrated in FIG. 5 are seal 26 and ring 30. If desired, body 14 may comprise threaded (nominally) upper and lower sections 34 and 38, respectively; as so threaded, the sections 34 and 38 may be connected or disconnected merely by rotating one relative to the other.

Illustrated as being present on lower section 38 are clips 40. The clips 40, when present, may connect to corresponding components of APC 41 so as to help interconnect assembly 10 and APC 41. Clips 40 thus may function similarly to clips of commonly-owned U.S. Patent Application Publication No. 2012/0137451 of Bauckman, et al. (the "Bauckman Application"), whose contents also are incorporated herein in their entirety by reference.

Body 14 defines main openings 42 and 46 and a hollow interior region therebetween. Water or other fluid thus may flow through body 14 from opening 42 to opening 46 (or vice-versa). Preferably, however, assembly 10 is used with a suction-type APC 41, in which case main opening 42 forms an inlet to body 14 and main opening 46 constitutes an outlet.

Also shown as included as parts of lower section 38 are at least one bypass opening 50 and one or more auxiliary openings 54. Bypass opening 50 may, but need not, have regular shape. Indeed, as illustrated in FIGS. 1-2 and 4-5, bypass opening 50 preferably is shaped irregularly, with its (nominally) lower boundary 58 being longer than its (nominally) upper boundary 62, (nominally) left boundary 66 being straight, and (nominally) right boundary 70 being curved. Persons skilled in the art will recognized that, even if shaped irregularly, bypass opening 50 may be shaped other than as depicted in FIGS. 1-2 and 4-5.

Beneficially, though, the irregular shaping of bypass opening 50 may help maintain generally constant flow through main opening 42 when the bypass opening 50 is open. This is because pressure differential change is a function of the square of flow rate rather than a linear function thereof. As piston 18 moves longitudinally within body 14, the effective size of bypass opening 50 (see, e.g., FIGS. 4A-C) likewise changes non-linearly. Auxiliary openings 54 allow (typically higher-pressure) pool water to communicate with the underside of flange 72 of piston 18.

Depicted as present on upper section 34 are protrusions 74. The protrusions 74, when present, may connect to corresponding channels 76 or recesses of hose section 78. Protrusions 74 thus may operate like protrusions of the Bauckman Application.

Spring 22 preferably biases piston 18 so that its sidewall 82 completely closes bypass opening 50. In preferred versions of assembly 10, optimal or desired fluid flow rates will result in sidewall 82 barely closing bypass opening 50, so that a small increase in flow rate thereafter will overcome force of spring 22 sufficiently to cause at least slight (nominally upward) movement of the piston 18. FIGS. 4A-B illustrate this concept: In FIG. 4A, the actual fluid flow rate is less than desired, and sidewall 82 completely closes bypass opening 50. By contrast, in FIG. 4B, the actual fluid flow rate approximates the desired rate; although sidewall 82 continues to close bypass opening 50 completely, it has moved (upward) so that marking 86 (shown in FIG. 4B as a solid dark-colored line) has become visible adjacent lower boundary 58.

Finally, for purposes of illustration in FIG. 4C, the actual fluid flow rate has become higher than desired. In this instance piston 18 has moved upward substantially, so that marking 86 is visible adjacent upper boundary 62. Bypass opening 50 thus is essentially completely open at this time, allowing substantial fluid to enter therethrough in lieu of all flow coming through APC 41.

In at least one version of assembly 10, ring 30 may be green in color and piston 18 may be red in color. Ring 30 may include a flange that abuts the end of piston 18 so as to add a color band thereto. Depending on the position of piston 18, as noted above, different colors (red, green, or both) may be visible. Of course, piston 18 and ring 30 need not necessarily be colored or, if colored, need not necessarily be colored red and green, respectively.

Figures 6A, 6B, 6C, 6D:
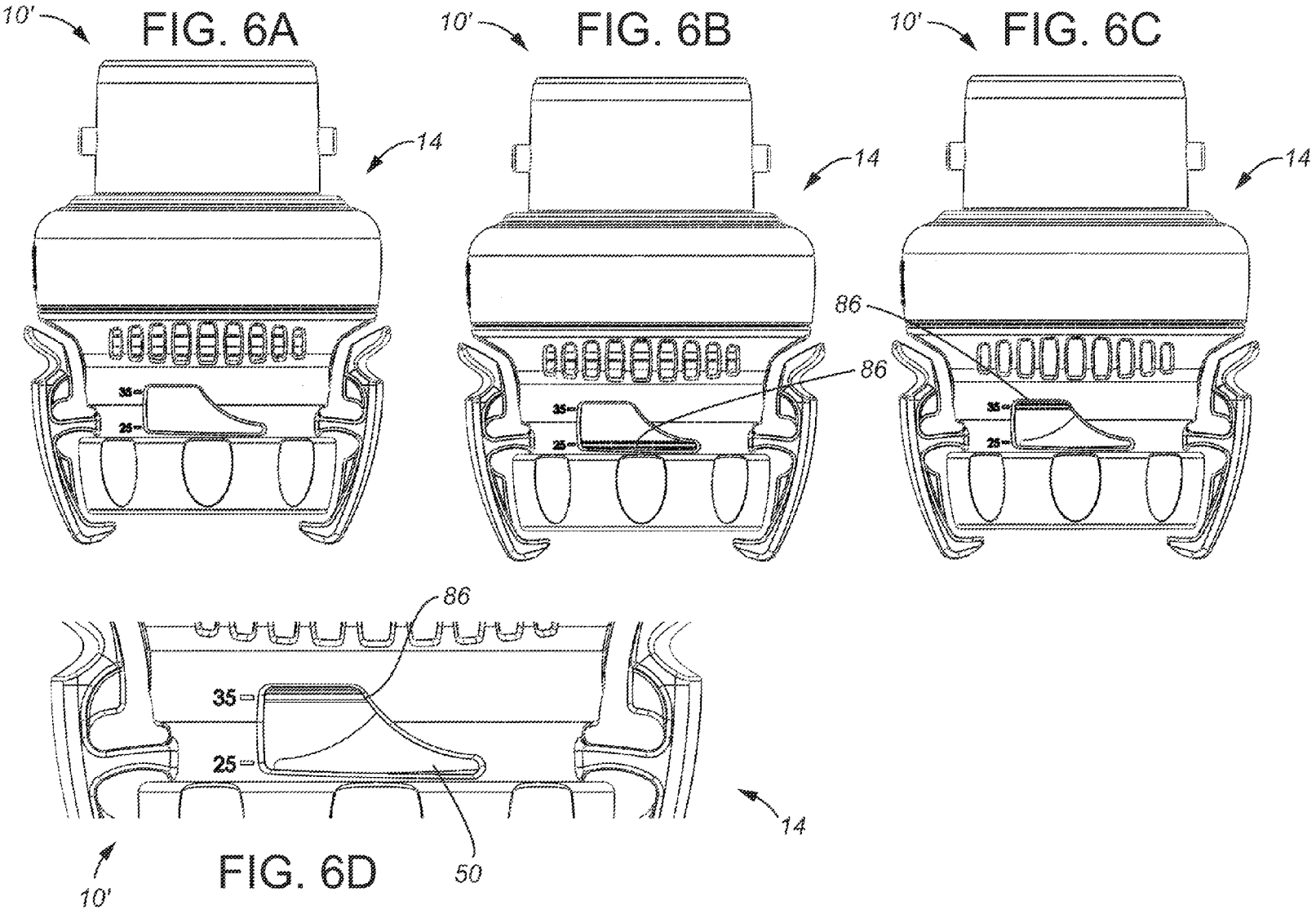
FIGS. 6A-D are elevational view of an alternate flow control assembly of the present invention illustrating different positions of a piston of the assembly.

FIGS. 6A-D similarly illustrate a manner of indicating flow rate in connection with a bypass opening 50. As shown therein, assembly 10' may include numeric (or other) flow rate indicators adjacent bypass opening 50, with positioning of marking 86 identifying a rate of flow through the assembly 10'. In the example of FIGS. 6A-D, numeric indicators "25" and "35" appear adjacent bypass opening 50, with "25" signifying that a flow rate of twenty-five gallons of fluid per minute is desired. Because marking 86 is not opposite indicator "25" in FIG. 6A, clear is that the actual flow rate through assembly 10' (and thus through APC 41) at the time of this example is less than desired. By contrast, marking 86 is opposite indicator "25" in FIG. 6B, indicating the desired flow rate has been achieved. FIGS. 6C-D depict marking 86 near indicator "35" instead, signifying that a substantially higher than desired flow rate of thirty-five gallons per minute is occurring. Persons skilled in the art will, of course, recognize that indicators "25" and "35" are not the only possible numeric indicators available for use, and assemblies 10 and 10' may function satisfactorily at flow rates lower or higher than the range bounded by twenty-five to thirty-five gallons per minute.

Figure 1:
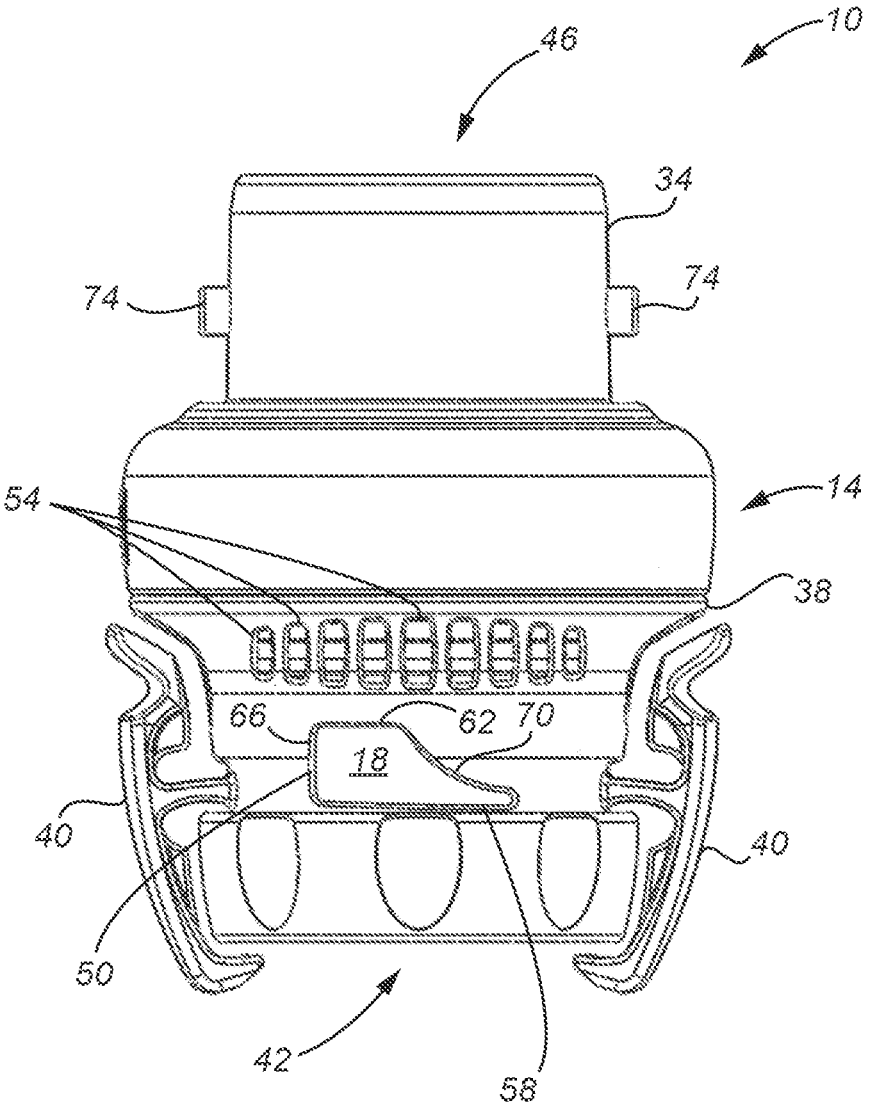
FIG. 1 is an elevational view of an exemplary flow control assembly of the present invention.
Figure 2:
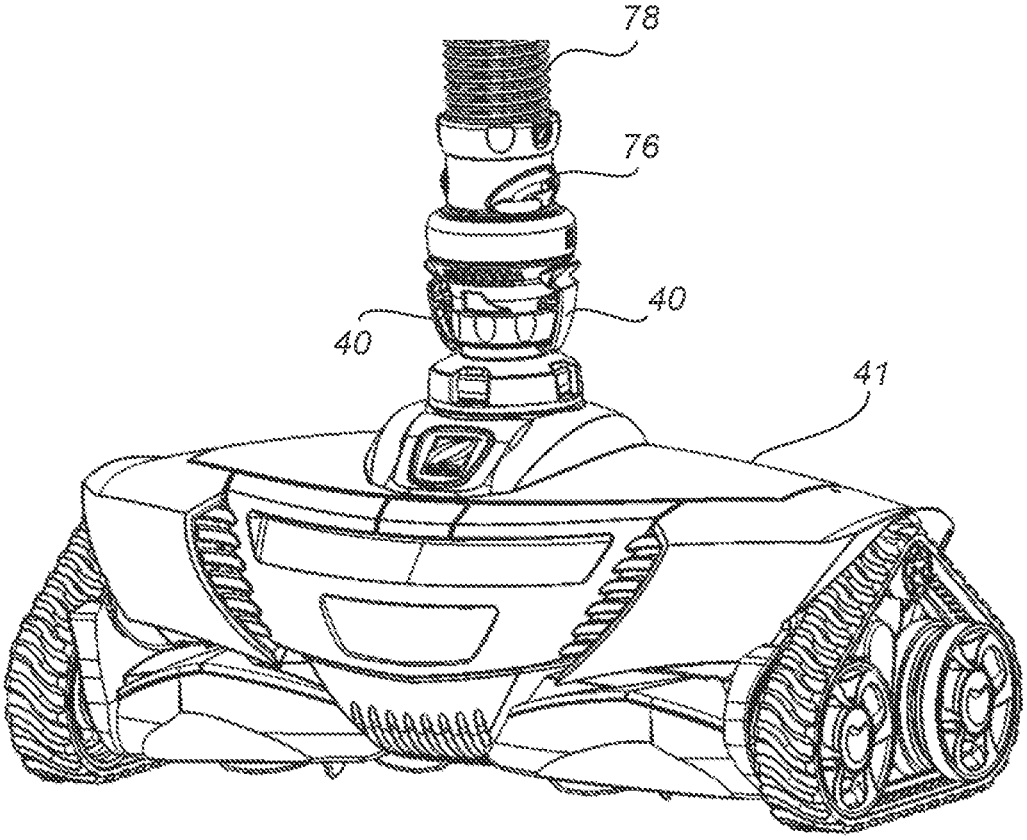
FIG. 2 is an elevational view of the assembly of FIG. 1 shown connected to an exemplary APC.
Figure 3:
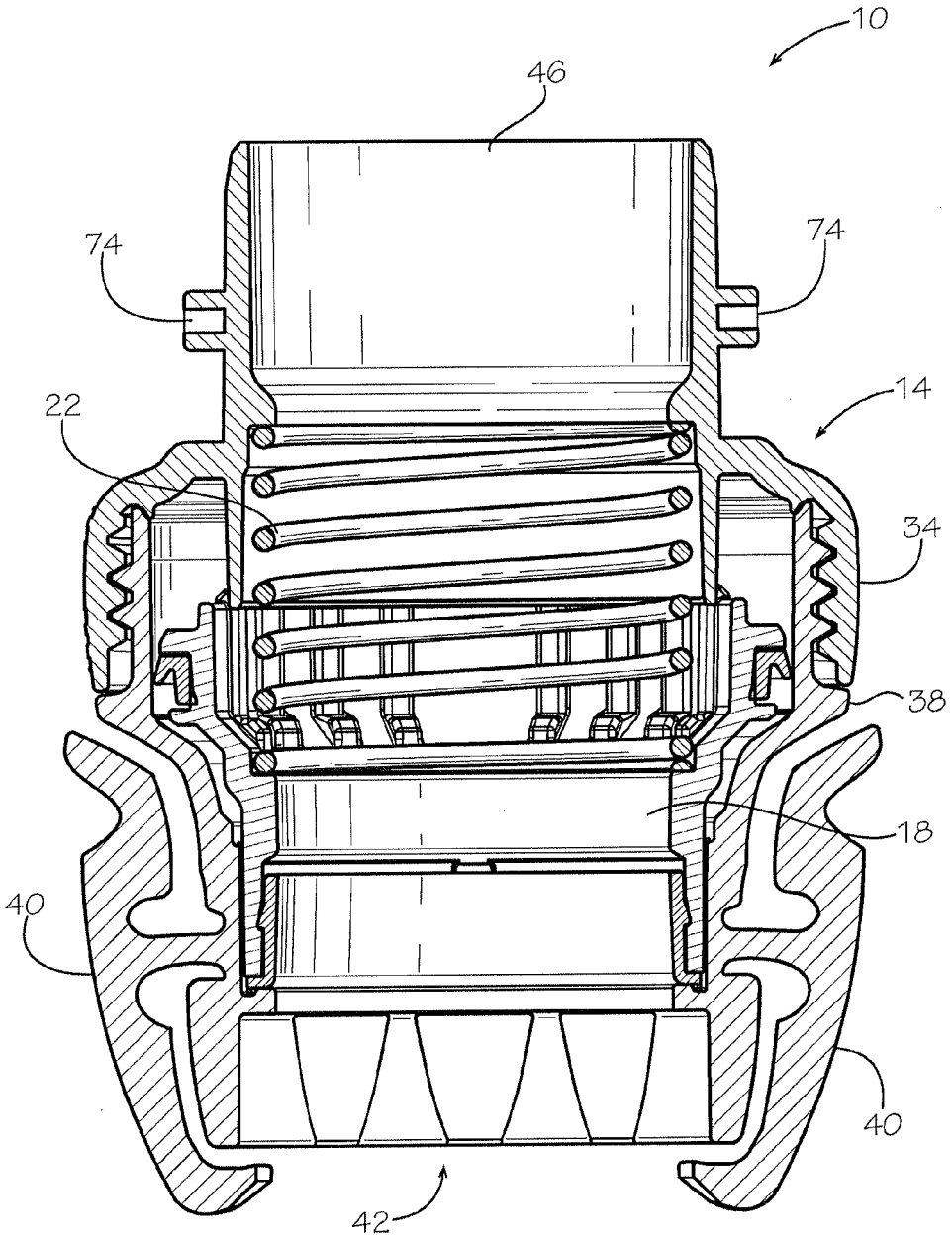
FIG. 3 is a cross-sectional view of the assembly of FIG. 1.

In a typical use in a pool or spa, assembly 10 (or 10') may be connected between a fluid outlet of APC 41 and a hose section 78, as shown in FIG. 2. Hose section 78 communicates (via other hose sections and pipes) to an inlet of water-recirculation pump. Activating the pump partially evacuates hose section 78 and APC 41, drawing debris-laden water into and through APC 41 (which may or may not include an internal debris filter) and then into body 14 through main opening 42. Depending on the rate of water flow through body 14 at any particular time, piston 18 will assume a position such that bypass opening 50 is either closed or open, with marking 86 continuously providing visual indication of the rate and of the extent to which bypass opening 50 has opened. Water having entered body 14 from either or both of main opening 42 and bypass opening 50 exits assembly 10 (or 10') through main opening 46 of the body 14 so as to enter hose section 78 and continue its travel toward the pump.

Figure 7C:
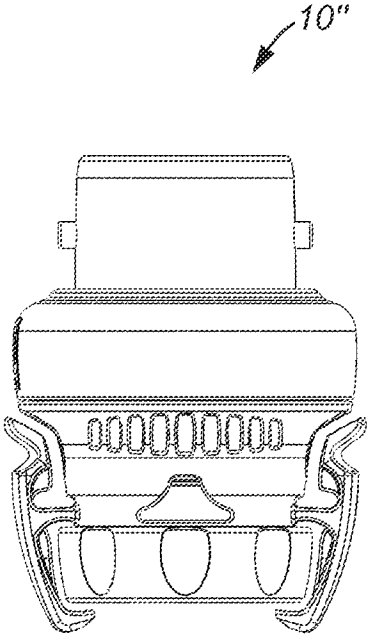
FIGS. 7A-C are elevational views of another alternate flow control assembly of the present invention illustrating different positions of a piston of the assembly.
Figure 7B:
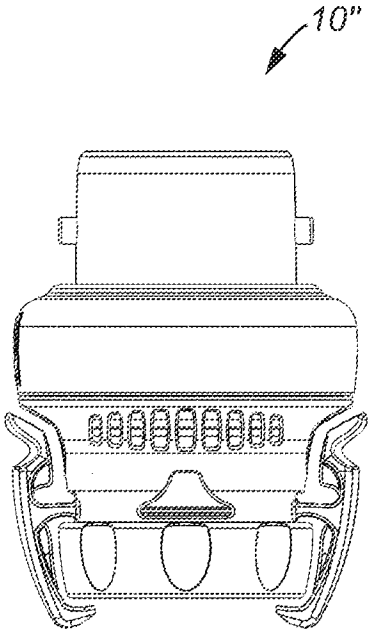
Figure 7A:
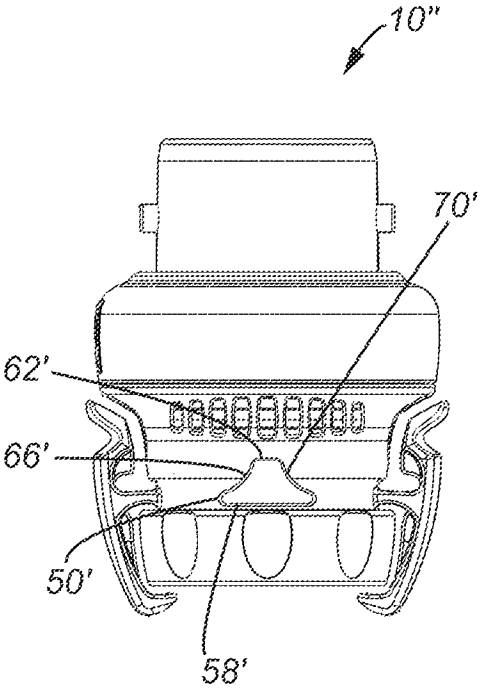

FIGS. 7A-C show another alternate flow control assembly 10". Assembly 10" may be identical or similar in many respects to assembly 10. However, as depicted in FIGS. 7A-C, assembly 10" may include bypass opening 50' shaped irregularly, albeit differently, than opening 50. Like boundaries 58, 62, and 70 of assembly 50, corresponding nominally lower boundary 58' of assembly 50" preferably is longer than normally upper boundary 62', with boundaries 58' and 62' being generally straight and nominally right boundary 70' being curved. By contrast, whereas nominally left boundary 66 of assembly 10 is generally straight, boundary 66' of assembly 10" may be curved.

The foregoing is provided for purposes of illustrating, explaining, and describing embodiments of the present invention. Further modifications and adaptations to these embodiments will be apparent to those skilled in the art and may be made without departing from the scope or spirit of the invention. Any terms of direction and relative positioning (e.g. upper, lower, upward, left, right, etc.) are used to identify nominal or preferred, rather than absolute, orientations or relationships of components and may be modified as appropriate.

What is claimed is:

1. A flow-control assembly for fluid, comprising: a. a body comprising (i) an inlet for fluid, (ii) an outlet for fluid, and (iii) a bypass opening for receiving fluid, the body defining a main fluid flow path between the inlet and the outlet; and b. a member (i) comprising an annular side wall within which fluid in the main fluid flow path flows in use and (ii) moveable within the main fluid flow path of the body, a position of the member (A) indicating, through the bypass opening, information about the fluid flow rate through the body and (B) controlling an amount of fluid received by the bypass opening.

2. An assembly according to claim 1 further comprising a spring and in which the member is a piston operating under influence of the spring.

3. An assembly according to claim 2 in which the spring biases the piston to a normal position closing the bypass opening.

4. An assembly according to claim 3 in which the piston is marked in a manner visible through the bypass opening.

5. An assembly according to claim 3 in which the body is marked such that the fluid flow rate through the body may be interpreted via a position of the piston.

6. An assembly according to claim 1 further comprising means for connecting the body to an automatic swimming pool cleaner so that the body moves within a pool together with the automatic swimming pool cleaner.

7. An assembly according to claim 6 in which the connecting means comprises clips.

8. An assembly according to claim 7 further comprising auxiliary openings for receiving fluid.

9. An assembly according to claim 6 further comprising means for connecting the body to a hose section configured to communicate with an inlet of a water-circulation pump so that the main fluid flow path extends between the automatic swimming pool cleaner and the inlet of the pump.

10. An assembly according to claim 1 in which the side wall moves longitudinally within the main fluid flow path of the body generally parallel to the bypass opening.

11. An assembly according to claim 1 in which movement of the member within the body changes a cross-sectional area of the bypass opening available for fluid to be received into the body.

12. A flow-control assembly for fluid, comprising:

a. a body comprising (i) an inlet for fluid, (ii) an outlet for fluid, and (iii) a bypass opening for receiving fluid;

b. a spring;

c. a piston (i) moveable within the body, a position of the piston indicating, through the bypass opening, information about the fluid flow rate through the body, (ii) operating under influence of the spring, (iii) biased by the spring to a normal position closing the bypass opening, and (iv) marked in a manner visible through the bypass opening; and d. auxiliary openings for receiving fluid; and in which (a) the piston comprises a flange having an underside and (b) the auxiliary openings allow fluid to communicate with the underside.

13. An assembly according to claim 12 in which the piston has a side wall closing the bypass opening when the piston is biased to the normal position.

14. An assembly according to claim 13 further comprising a ring abutting the piston.

15. A swimming pool cleaning system comprising: a. an automatic swimming pool cleaner; and b. a flow-control assembly connected to the automatic swimming pool cleaner and comprising: i. a body comprising (A) an inlet for fluid, (B) an outlet for fluid, and (C) a bypass opening for receiving fluid, the body defining a main fluid flow path between the inlet and the outlet; and ii. a member (A) comprising an annular side wall within which fluid in the main fluid flow path flows in use and (B) moveable within the main fluid flow path of the body, a position of the member indicating, through the bypass opening, information about the fluid flow rate through the body and controlling an amount of fluid received by the bypass opening.

16. A system according to claim 15 further comprising a hose section connected to the flow-control assembly.

17. A system according to claim 16 in which the automatic swimming pool cleaner is connected to the inlet of the body and the hose section is connected to the outlet of the body.

18. A system according to claim 17 in which the hose section is connected directly or indirectly to an inlet of a pump.

19. A system according to claim 15 in which movement of the member within the body changes a cross-sectional area of the bypass opening available for fluid to be received into the body.

* * * * *